US007001210B1

(12) United States Patent
Chiang

(10) Patent No.: US 7,001,210 B1
(45) Date of Patent: Feb. 21, 2006

(54) WIRE WINDING DEVICE FOR RECEIVING NETWORK WIRES OR TELEPHONE WIRES

(76) Inventor: Wu Sung Chiang, 235 P.O. Box 8-24 Chung-Ho, Taipei (TW)

( * ) Notice: Subject to any disclaimer, the term of this patent is extended or adjusted under 35 U.S.C. 154(b) by 0 days.

(21) Appl. No.: 11/085,684

(22) Filed: Mar. 22, 2005

(51) Int. Cl.
*H01R 13/72* (2006.01)

(52) U.S. Cl. ..... 439/501; 439/4; 242/378.2

(58) Field of Classification Search ..... 439/501, 439/4; 242/378, 378.1, 378.2; 191/12.2 R, 191/12.4
See application file for complete search history.

(56) References Cited

U.S. PATENT DOCUMENTS 4,384,688 A * 5/1983 Smith ..... 242/378.2
4,946,010 A * 8/1990 DiBono ..... 191/12.2 R
6,733,328 B1 * 5/2004 Lin et al. ..... 439/501
6,834,820 B1 * 12/2004 Wei ..... 242/378
6,851,530 B1 * 2/2005 Wei ..... 191/12.2 R
6,866,219 B1 * 3/2005 Wei ..... 242/378.1

* cited by examiner

*Primary Examiner*—Tho D. Ta

(57) ABSTRACT

A wire winding device for receiving network wires or telephone wires is disclosed. The round post of the lower cover passes through the via hole of the circuit board, the central hole of the conducting plate, the via hole of the insulating plate; the buckling hole of the spring; the via hole of the spring seat, and the via hole of the upper cover, sequentially. The buckle sheet is engaged to the upper cover. The buckling post of the buckle sheet is movable fixed to the buckling groove. The upper cover and lower cover are combined. The electric wire of the circuit board and the electric wire of the conducting plate are placed in the slot of the upper cover and the slot of the lower cover. A screw serves to lock the upper cover to the lower cover.

3 Claims, 6 Drawing Sheets

WIRE WINDING DEVICE FOR RECEIVING NETWORK WIRES OR TELEPHONE WIRES

FIELD OF THE INVENTION

The present invention relates to wire winding devices, and in particular to a wire winding device for receiving network wires or telephone wires, wherein the wire in the device can be connected to a computer or a telephone and furthermore, the electric wire can be received within a wall or a desk so as to have a beautiful outlook. Thereby since the wall is wound in the cover, it can be carried conveniently.

BACKGROUND OF THE INVENTION

Currently, a computer is connected to other devices by electric wires through the connections of plugs, such as USB plugs. Generally, in some usage, the wire is made as an extension wire which is an independent wire. The wire is portable. In use, one end of the wire is connected to a computer and another end of the wire is connected to an appliance device. However this prior art design is difficult to be arranged in order. Thereby it is inconvenient to carry a wire. The wire is difficult to be arranged in order for storage. Thereby these inconvenient makes the wire easily damaged. Furthermore, the prior art wire is generally used for computer devices, but it cannot be used for telephones. Thereby there is an eager demand for a novel design to improve the prior art defects.

SUMMARY OF THE INVENTION

The present invention has been accomplished to provide a wire winding device for receiving network wires or telephone wires, wherein the wire in the device can be connected to a computer or a telephone and furthermore, the electric wire can be received within a wall or a desk so as to have a beautiful outlook. Thereby since the wall is wound in the cover, it can be carried conveniently. Thereby the electric wire of the present invention can be used in various devices.

It is one object of the present invention to provide a wire winding device for receiving network wires or telephone wires. The round post of the lower cover passes through the via hole of the circuit board, the central hole of the conducting plate, the via hole of the insulating plate; the buckling hole of the spring; the via hole of the spring seat, and the via hole of the upper cover, sequentially. The buckle sheet is engaged to the upper cover. The buckling post of the buckle sheet is movable fixed to the buckling groove. The upper cover and lower cover are combined. The electric wire of the circuit board and the electric wire of the conducting plate are placed in the slot of the upper cover and the slot of the lower cover. A screw serves to lock the upper cover to the lower cover.

Further objectives and advantages of the present invention will become apparent from a careful reading of a detailed description provided hereinbelow, with appropriate reference to accompanying drawings.

DETAILED DESCRIPTION OF THE INVENTION

Figure 1:
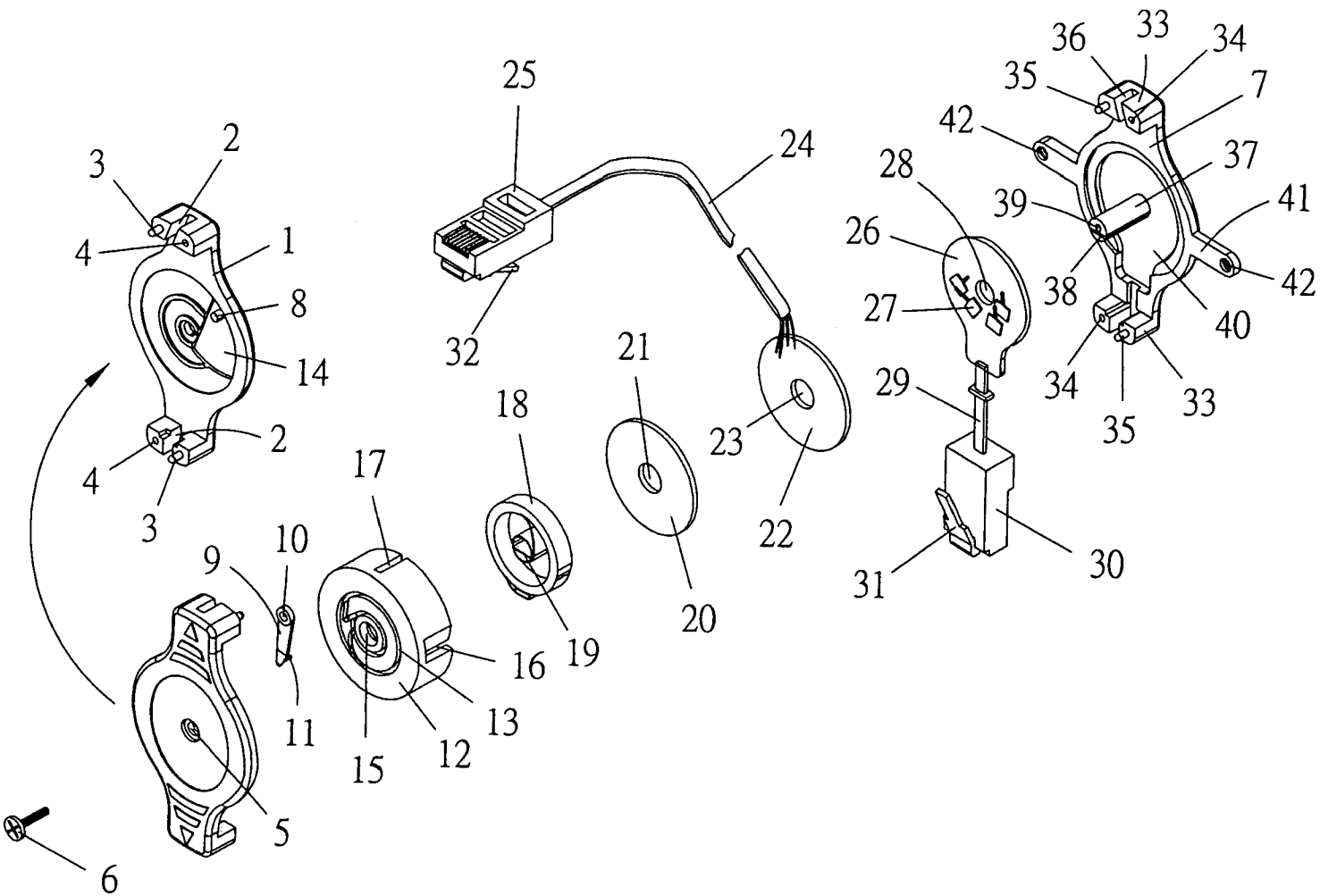
FIG. 1 is an exploded view of the first embodiment of the present invention.
Figure 2:
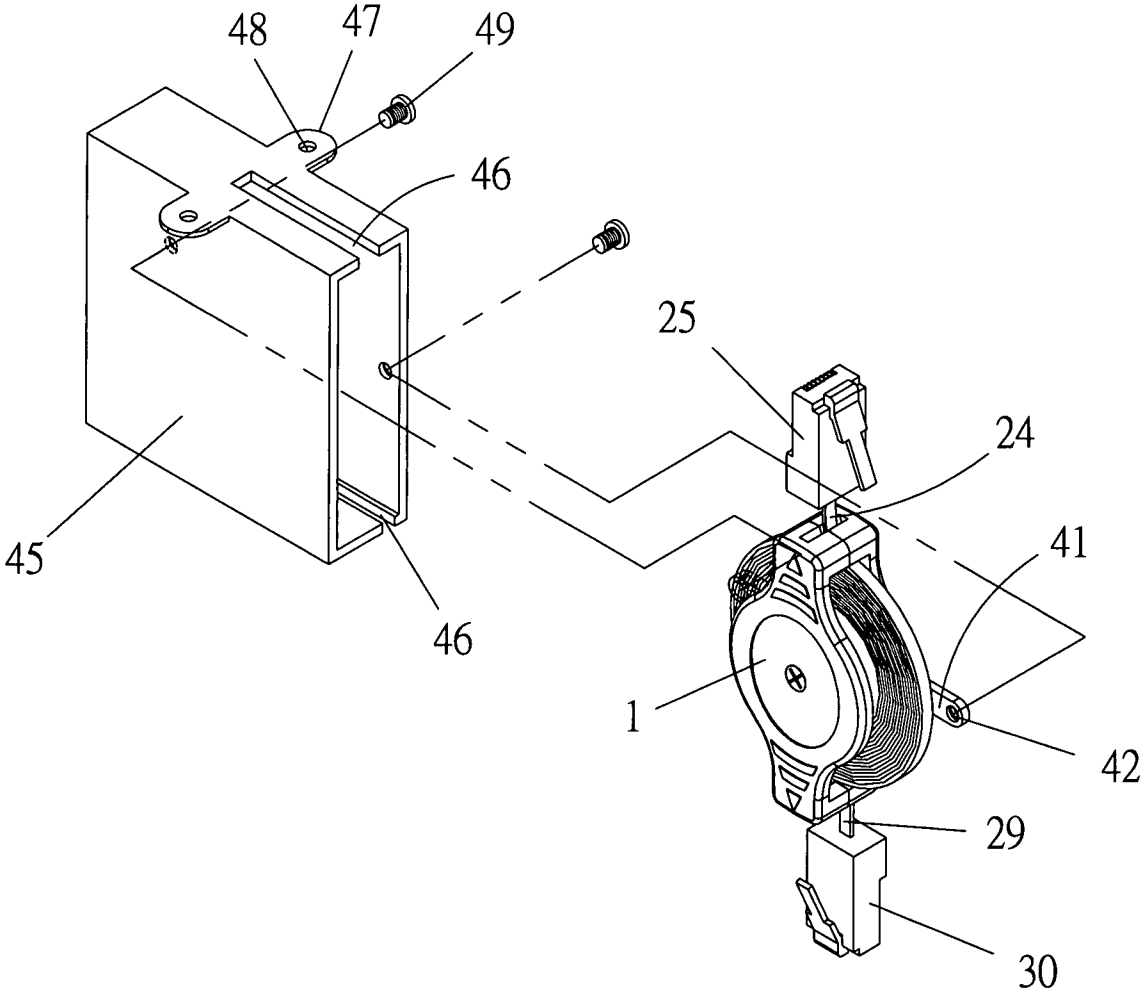
FIG. 2 is a schematic view about the assembly of first embodiment of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1, 2, 3, 4 and 5, the present invention is illustrated. The present invention is related to a wire winding device which can be hidden in a wall. The device has a multi-functional joint which can be pulled out to be connected to a computer or a telephone. The device comprises the following elements.

An upper cover 1 has two ends. Each end has two protrusion posts. The two protrusion posts are formed with a slot 2 therebetween. One of the two protrusion posts at the same end has a tenon 3 and the other has a groove 4 corresponding to the tenon 3. A center of the upper cover 1 has a via hole 5 for receiving a screw 6. An inner side of the upper cover 1 is formed with a small post 8. A sector area 14 is formed at a periphery of the small post 8. A buckle sheet 9 is engaged to the small post 8. One end of the buckle sheet 9 is formed with a via hole 10. The buckle sheet 9 is moved along the sector area 14.

A lower cover 7 is locked to the upper cover 1. Another end of the buckle sheet 9 is formed with a buckling post 11.

A spring seat 12 is an annular body. A bottom of the spring seat 12 has a buckling groove 13 capable of receiving the buckling post 11. A center of the buckling groove 13 has a via hole 15. A larger notch 16 and a small notch 17 are formed at a periphery of the spring seat 12.

A wire winding spring 18 is wound as a disk shape with a buckling hole 19 at a center thereof.

An insulating plate 20 is made of insulating material. A center of the insulting plate 20 has a via hole 21 for positioning.

A conductive plate 22 has a central hole 23 at a center thereof. One end of the conducting plate 22 is connected with two electric wires 24, (in the drawing, only one electric wire 24 is illustrated. Another wire can be connected from another slot). Each electric wire 24 is connected to a multi-functional joint 25 for being connected to a network or a telephone. Each joint 25 is extended with a buckle piece 32.

A circuit board 26 has a plurality of elastic heads 27 for conduction. A center of the circuit board 26 has a via hole 28. One side of the circuit board 26 is connected to an electric wire 29. One end of the electric wire 29 has a plug 30 for being connected to an input end of a network or a telephone. The plug 30 is extended with a connecting sheet 31.

The lower cover 7 has two ends. Each end has two protrusion posts 33. A slot 36 is formed between the two protrusion posts 33 for receiving one of the electric wires 24, 29. One of the protrusion posts 33 has a recess 34 and the other protrusion post has a rod 35 corresponding to the recess 34. A center of the lower cover 7 is formed with a round bar 37. The bar 37 has a notch 38. A top of the bar 37 has a screw hole 39. A center area of the lower cover 7 has a receiving recess 40 around the round bar 37. Two ends of the lower cover 7 have two wings 41, respectively. Each wing 40 has a screw hole 42.

A container 45 serve for containing above mentioned elements. Each of two opposite sides of the container 45 has an opening 46 for receiving the electric wires 24, 29. Thereby the joints 25 and the plug 30 are protruded out of the openings 46. Another side of the container 46 has two ears 47. Each ear 47 has a via hole 48 for being fixed to a wall by using a screw 49.

Figure 3:
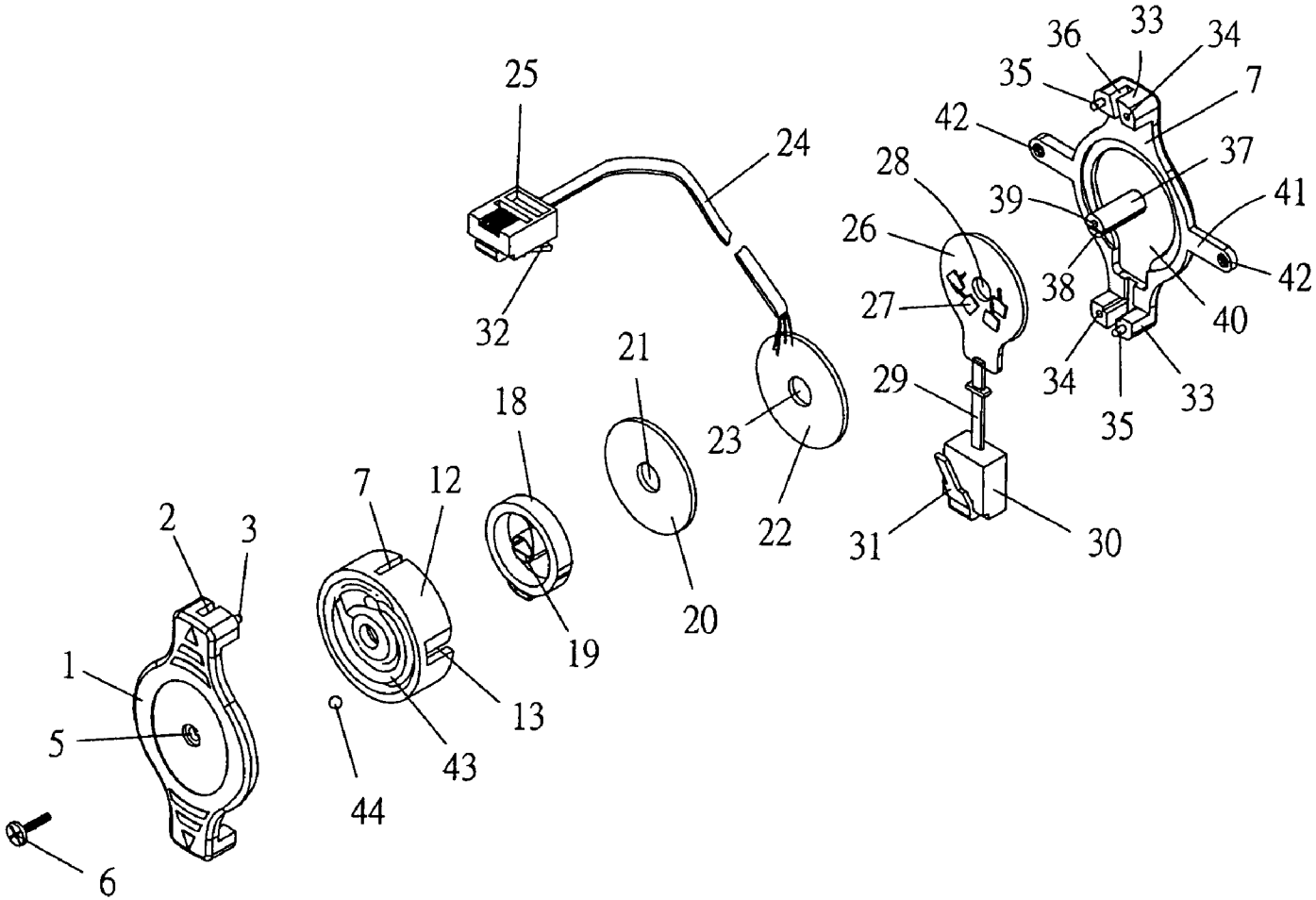
FIG. 3 is an exploded perspective view about the second embodiment of the present invention.
Figure 4:
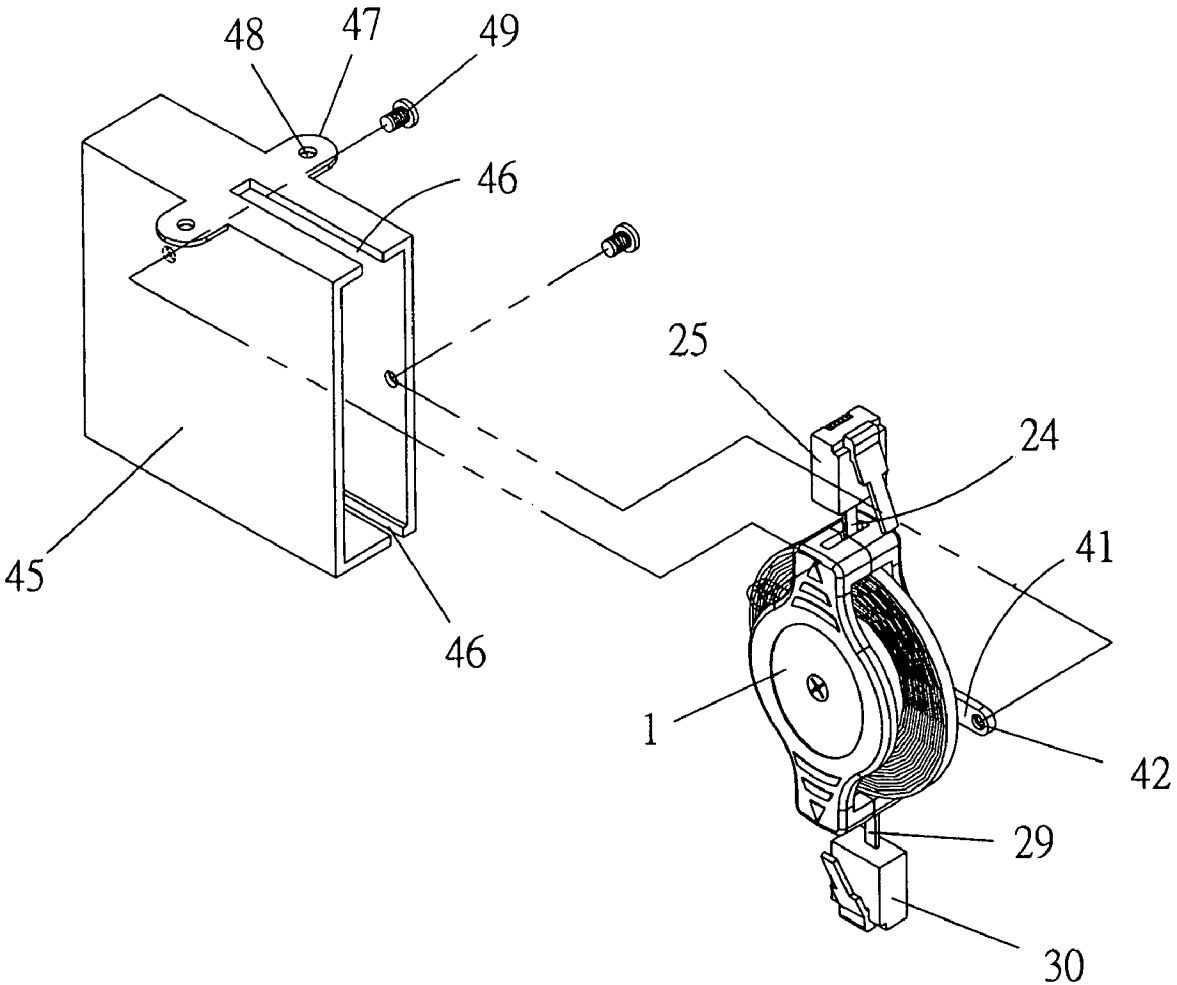
FIG. 4 is a schematic view about the assembly of the second embodiment of the present invention.
Figure 5:
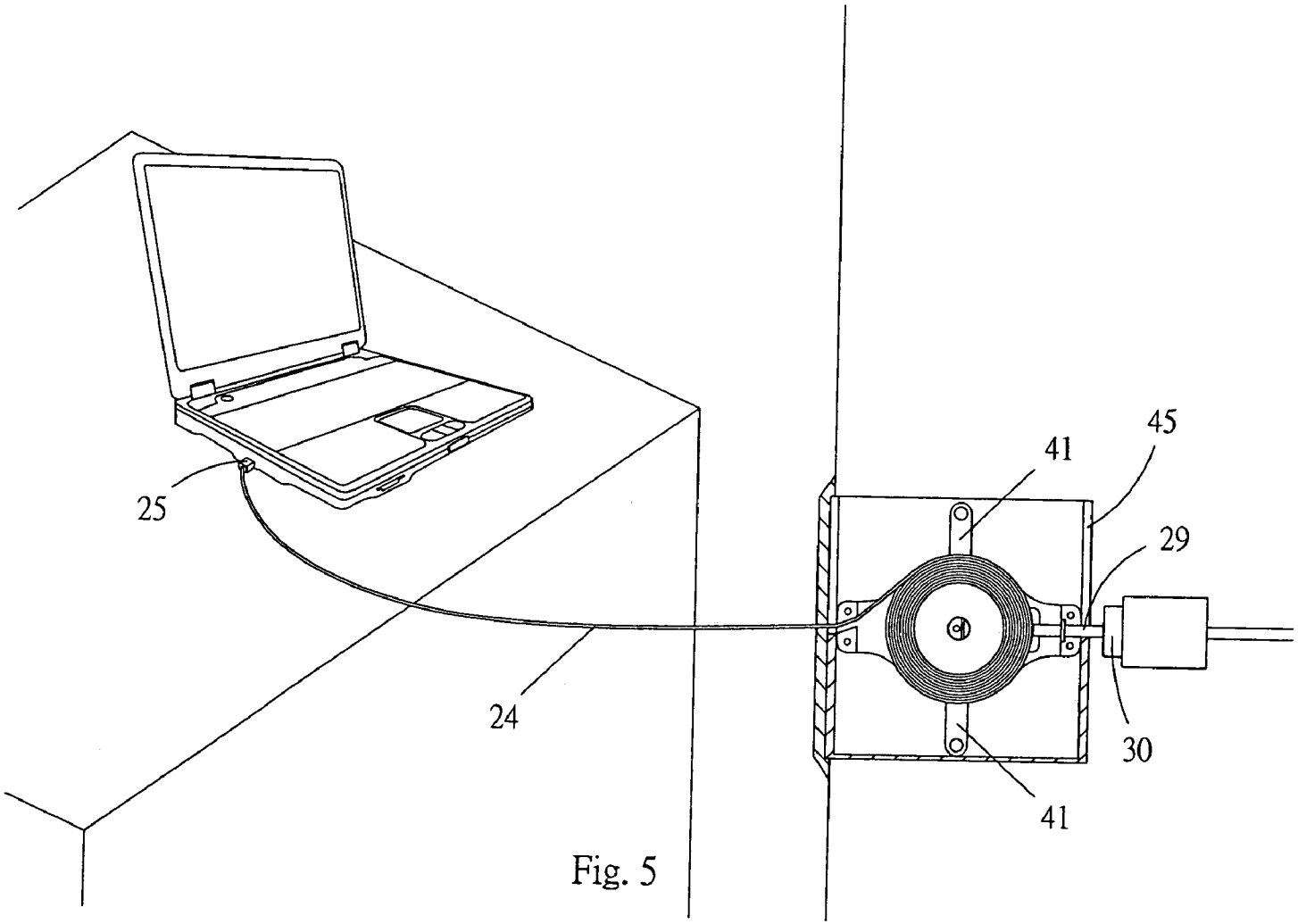
FIG. 5 shows that the present invention is connected to a computer.
Figure 6:
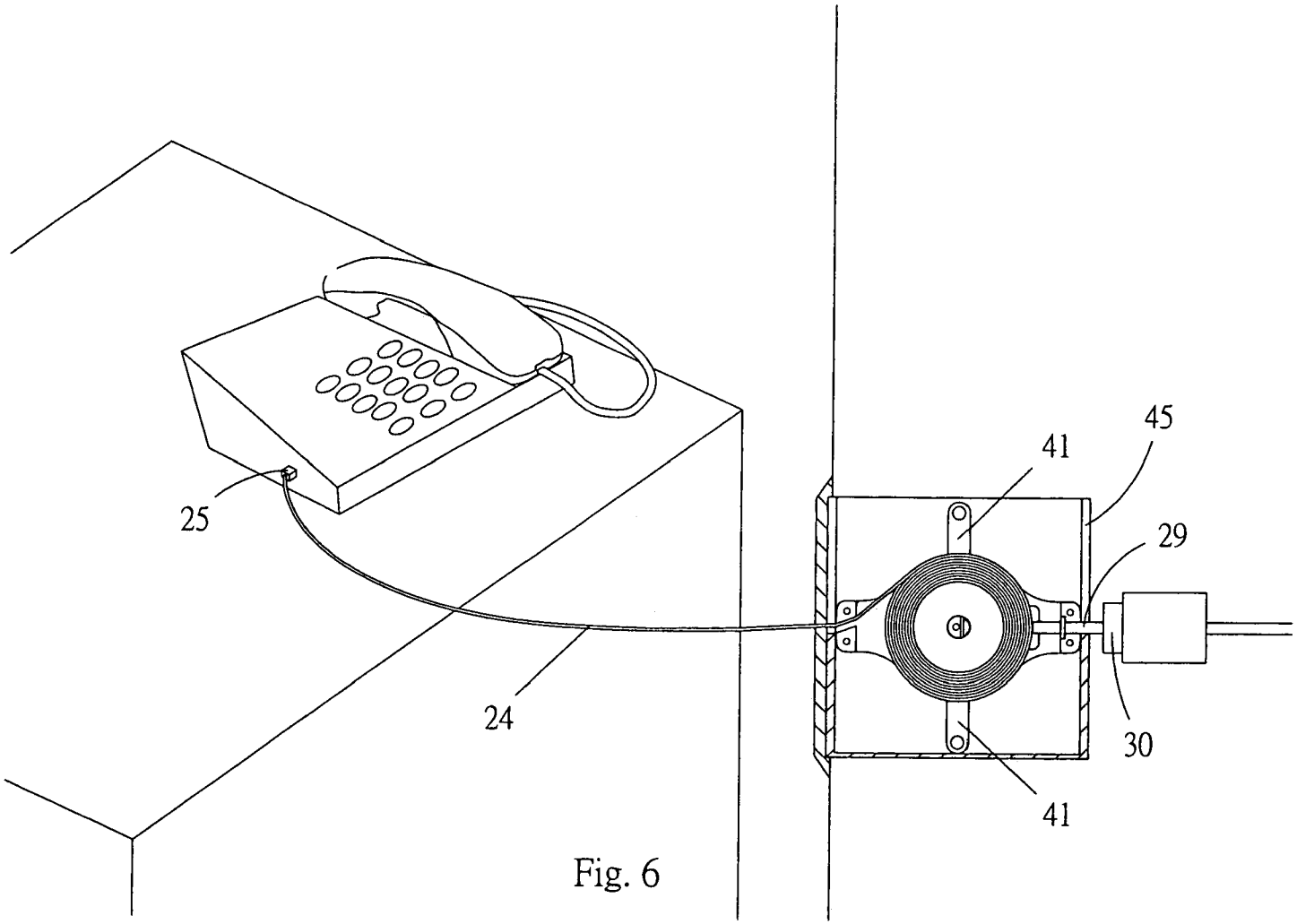
FIG. 6 shows that the present invention is connected to a telephone.

Furthermore, referring to FIGS. 3, 4, and 6, in the present invention, the buckling groove 43 of the spring seat may be installed with a rolling ball 44 (referring to FIGS. 3,4, and 5) so as to be as a wire winding device 45 with a rolling ball. Other elements of the wire winding device 45 are same above mentioned.

The assembly of the present invention will be described herein. The round bar 37 of the lower cover 7 passes through the via hole 28 of the circuit board 26, the central hole 23 of the conducting plate 22, the via hole 21 of the insulating plate 20, the buckling hole 19 of the spring 18, the via hole 15 of the spring seat 12, and the via hole 5 of the upper cover 1, sequentially. The buckle sheet 9 is engaged to the upper cover 1. The buckling post 11 of the buckle sheet 9 is movably fixed to the buckling groove 13. The upper cover 1 and lower cover 7 are combined. The electric wire 29 of the circuit board 26 and the electric wire 24 of the conducting plate 22 are placed in the slot of the upper cover 1 and the slot 36 of the lower cover 7. The screw 6 serves to lock the upper cover 1 to the lower cover 7. When the present invention is fixed to a wall, the plug 30 is connected to a network or a telephone. When a force is applied to the joint 25, the electric wire 24 can be pulled out. Thereby the present invention can solve the problem of forgetting to carry a network or a telephone wire.

When the present invention is not used, the electric wire 24 will be wound into the original position. Thereby the retaining of the present invention will make it difficult to be theft. When the present invention is not used, it has a beautiful outlook.

FIGS. 5 and 6 show the use of the present invention. In the present invention, the joint 25 can be connected to a computer or a telephone. The plug 30 is connected to another end of an application device.

Advantages of the present invention will be described herein. The present invention can be connected to a computer or a telephone and furthermore, the electric wire can be received within a wall or a desk so as to have a beautiful outlook. Thereby since the wall is wound in the cover so that it can be carried conveniently. Thereby the electric wire of the present invention can be used in various devices.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A wire winding device for receiving network wires or telephone wires, the wire winding device being capable of being hidden within a wall or a desk; when the wire is pulled out, it can be connected to a computer or a telephone, comprising:

an upper cover having two ends; each end having two protrusion posts; the two protrusion posts being formed with a slot therebetween; one of the two protrusion posts at the same end having a tenon and the other having a groove corresponding to the tenon; a center of the upper cover having a via hole for receiving a screw; an inner side of the upper cover being formed with a small post; a sector area being formed at a periphery of the small post; a buckle sheet being engaged to the small post; one end of the buckle sheet being formed with a via hole; the buckle sheet being movable along the sector area;

a lower cover locked to the upper cover; another end of the buckle sheet being formed with a buckling post;

a spring seat being an annular body; a bottom of the spring seat having a buckling groove capable of receiving the buckling post; a center of the buckling groove having a via hole; a larger notch and a small notch being formed at a periphery of the spring seat;

a wire winding spring being wound as a disk shape with a buckling hole at a center thereof;

an insulating plate being made of insulating material; a center of the insulting plate having a via hole for positioning;

a conductive plate having a central hole at a center thereof; one end of the conducting plate being connected with two electric wires, each electric wire being connected to a multi-functional joint for being connected to a network or a telephone; each joint being extended with a buckle piece;

a circuit board having a plurality of elastic heads for electric conduction; center of the circuit board having a via hole; one side of the circuit board being connected to an electric wire; one end of the electric wire having a plug for being connected to an input end of a network or a telephone; the plug being extended with a connecting sheet;

the lower cover having two ends; each end having two protrusion posts; a slot being formed between the two protrusion posts for receiving one of the electric wires; one of the protrusion posts having a recess and the other protrusion post having a rod corresponding to the recess; a center of the lower cover being formed with a round bar; the bar having a notch; a top of the bar having a screw hole; a center area of the lower cover having a receiving recess around the round bar; two ends of the lower cover having two wings, respectively; each wing having a screw hole; and a container for containing the wire winding device; each of two opposite sides of the container having an opening for receiving the electric wires; thereby the joint and the plug being protruded out of the openings; another side of the container having two ears; each ear having a via hole for being fixed to a wall by using a screw.

2. The wire winding device for receiving network wires or telephone wires as claimed in claim 1, wherein the buckling groove of the spring seat is installed with a rolling ball so as to be as a wire winding device.

3. The wire winding device for receiving network wires or telephone wires as claimed in claim 1, wherein the round bar of the lower cover passes through the via hole of the circuit board, the central hole of the conducting plate, the via hole of the insulating plate; the buckling hole of the spring; the via hole of the spring seat, and the via hole of the upper cover, sequentially; the buckle sheet is engaged to the upper cover; the buckling post of the buckle sheet is movably fixed to the buckling groove; the upper cover and lower cover are combined; the electric wire of the circuit board and the electric wire of the conducting plate are placed in the slot of the upper cover and the slot of the lower cover; the screw engages the screw hole of the round bar to lock the upper cover to the lower cover.

* * * * *